US009723664B2

(12) United States Patent
Lin et al.

(10) Patent No.: US 9,723,664 B2
(45) Date of Patent: Aug. 1, 2017

(54) CONTROL METHODS AND POWER CONVERTERS SUITABLE FOR TRIAC DIMMING

(71) Applicant: Leadtrend Technology Corporation, Hsinchu (TW)

(72) Inventors: Chang Yi Lin, Hsinchu (TW); Kuo Chien Huang, Hsinchu (TW); Chi Pin Chen, Hsinchu (TW)

(73) Assignee: LEADTREND TECHNOLOGY CORPORATION, Hsinchu (TV)

( * ) Notice: Subject to any disclaimer, the term of this patent is extended or adjusted under 35 U.S.C. 154(b) by 0 days.

(21) Appl. No.: 14/725,045

(22) Filed: May 29, 2015

(65) Prior Publication Data

US 2015/0359054 A1 Dec. 10, 2015

(30) Foreign Application Priority Data

Jun. 5, 2014 (TW) ..... 103119532 A

(51) Int. Cl.
*H05B 33/08* (2006.01)

(52) U.S. Cl.
CPC ..... *H05B 33/0815* (2013.01); *H05B 33/0845* (2013.01); *H05B 33/0887* (2013.01)

(58) Field of Classification Search
USPC ..... 315/206
See application file for complete search history.

(56) References Cited

U.S. PATENT DOCUMENTS 7,239,532 B1 * 7/2007 Hsu ..... H02M 3/33523 363/21.12
7,932,682 B2 * 4/2011 Ziegler ..... H02M 1/36 315/226
8,305,775 B2 * 11/2012 Shimada ..... H02M 1/36 363/21.02
8,339,056 B1 * 12/2012 Xiong ..... H05B 41/2828 315/224
8,339,816 B2 * 12/2012 Saji ..... H02M 3/33507 363/21.12
8,441,210 B2 * 5/2013 Shteynberg ..... H05B 33/0815 315/209 R (Continued)

FOREIGN PATENT DOCUMENTS

TW 201043083 A1 12/2010
TW I439169 5/2014

*Primary Examiner* — Alexander H Taningco
*Assistant Examiner* — Nelson Correa
(74) *Attorney, Agent, or Firm* — McClure, Qualey & Rodack, LLP

(57) ABSTRACT

Control methods and apparatuses providing a holding current for a TRIAC dimmer are disclosed. A control method is suitable for a power controller powered by an operation power source. A high-voltage device in the power controller is connected between the operation power source and an input power source, from which the high-voltage device drains a conduction current. An operation voltage of the operation power source is detected, and, during a startup procedure, the conduction current is forwarded to charge the operation power source. A detected voltage representing an input voltage of the input power source is provided, and if the detected voltage is below a setting voltage, the conduction current is forwarded to a ground line instead of charging the operation power source.

8 Claims, 4 Drawing Sheets

(56) References Cited

U.S. PATENT DOCUMENTS

| | | | | |
|---|---|---|---|---|
| 8,604,646 | B2 * | 12/2013 | Chen | G06F 1/26 307/125 |
| 8,629,631 | B1 * | 1/2014 | Rhodes | H02M 1/36 315/227 R |
| 9,220,133 | B2 * | 12/2015 | Salvestrini | H05B 33/0815 |
| 2015/0029767 | A1 * | 1/2015 | Chou | H02M 3/00 363/49 |

* cited by examiner leading-edge TRIAC dimmer trailing-edge TRIAC dimmer

CONTROL METHODS AND POWER CONVERTERS SUITABLE FOR TRIAC DIMMING

CROSS-REFERENCE TO RELATED APPLICATION

This application claims priority to and the benefit of Taiwan Application Series Number 103119532 filed on Jun. 5, 2014, which is incorporated by reference in its entirety.

BACKGROUND

The present disclosure relates generally to control methods and apparatuses relevant to TRIACs, more specially to control methods and apparatuses for providing the holding current that a TRIAC needs for proper operation.

TRIAC dimmers are designed for resistive loads such as incandescent or halogen lights, and they have been significantly installed in the United States and worldwide. Unfortunately, these phase-controlled dimmers are not readily compatible with LEDs since LEDs do not appear as a resistive load. Therefore LED-based solutions using traditional LED drivers will not perform as expected with TRIAC wall dimmers.

A TRIAC dimmer blocks or cuts off a portion of the waveform of an alternating-current (AC) voltage power source, so as to reduce the power transferred through and to dim the light source that the TRIAC drives. Therefore, TRIAC dimmers are also named as phase-cut dimmers. FIGS. 1 and 2 demonstrate waveforms generated by a leading-edge TRIAC dimmer and a trailing-edge TRIAC dimmer, respectively. Waveform 100 represents the voltage of an AC outlet connected to a power grid. The shadowed areas 110 mean the portions of the waveform 100 that a TRIAC dimmer bypasses to a load. A cutoff time $T_{CUTOFF}$ refers to a period of time when a TRIAC dimmer blocks the AC voltage of the power grid; and a conduction time $T_{CONDUCTION}$ refers to a period of time when a TRIAC dimmer just bypasses the AC voltage to a load.

As shown in FIGS. 1 and 2, the voltage across a load during a cutoff time $T_{CUTOFF}$ is almost 0V. Nevertheless, a load must drain a minimum amount of current during a cutoff time $T_{CUTOFF}$ to keep a TRIAC dimmer work properly, and this current is called holding current in the art. When the holding current becomes zero, a TRIAC dimmer restarts or resets. The holding currents for different TRIAC dimmers differ, depending on their designs and specifications.

It is a challenge for power converter manufactures to design a LED driver capable of providing a holding current during the cutoff time $T_{CUTOFF}$.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified. These drawings are not necessarily drawn to scale. Likewise, the relative sizes of elements illustrated by the drawings may differ from the relative sizes depicted.

The invention can be more fully understood by the subsequent detailed description and examples with references made to the accompanying drawings, wherein.

DETAILED DESCRIPTION

An embodiment of the invention provides a power converter controlled under a power controller to convert an input power source and to generate an output power source. An AC voltage from a mains supply is inputted to a TRIAC dimmer, whose output is for generating the input power source. The power controller is equipped with a high-voltage startup circuit, which has an embedded high-voltage device for draining, during a startup procedure, a conduction current from the input power source, to charge an operation power source powering the power controller itself. The power controller can detect an input voltage of the input power source. When the input voltage is below a threshold, an occurrence of a cutoff time $T_{CUTOFF}$ when a TRIAC dimmer blocks is determined, and accordingly the conduction current through the high-voltage device is stopped from charging the operation power source, but is instead released to a ground line, and acts as the holding current required for proper operation of the TRIAC dimmer.

To accommodate a TRIAC dimmer that requires a minimum holding current larger than the maximum conduction current that the high-voltage device can conduct, an embodiment of the invention discloses a discharge circuit, which is triggered by the occurrence of the conduction current to provide a discharge current. The discharge current also drains from the input power source to the ground line. During a cutoff time $T_{CUTOFF}$, the discharge current and the conduction current together act as the holding current for the TRIAC dimmer.

Figure 3:
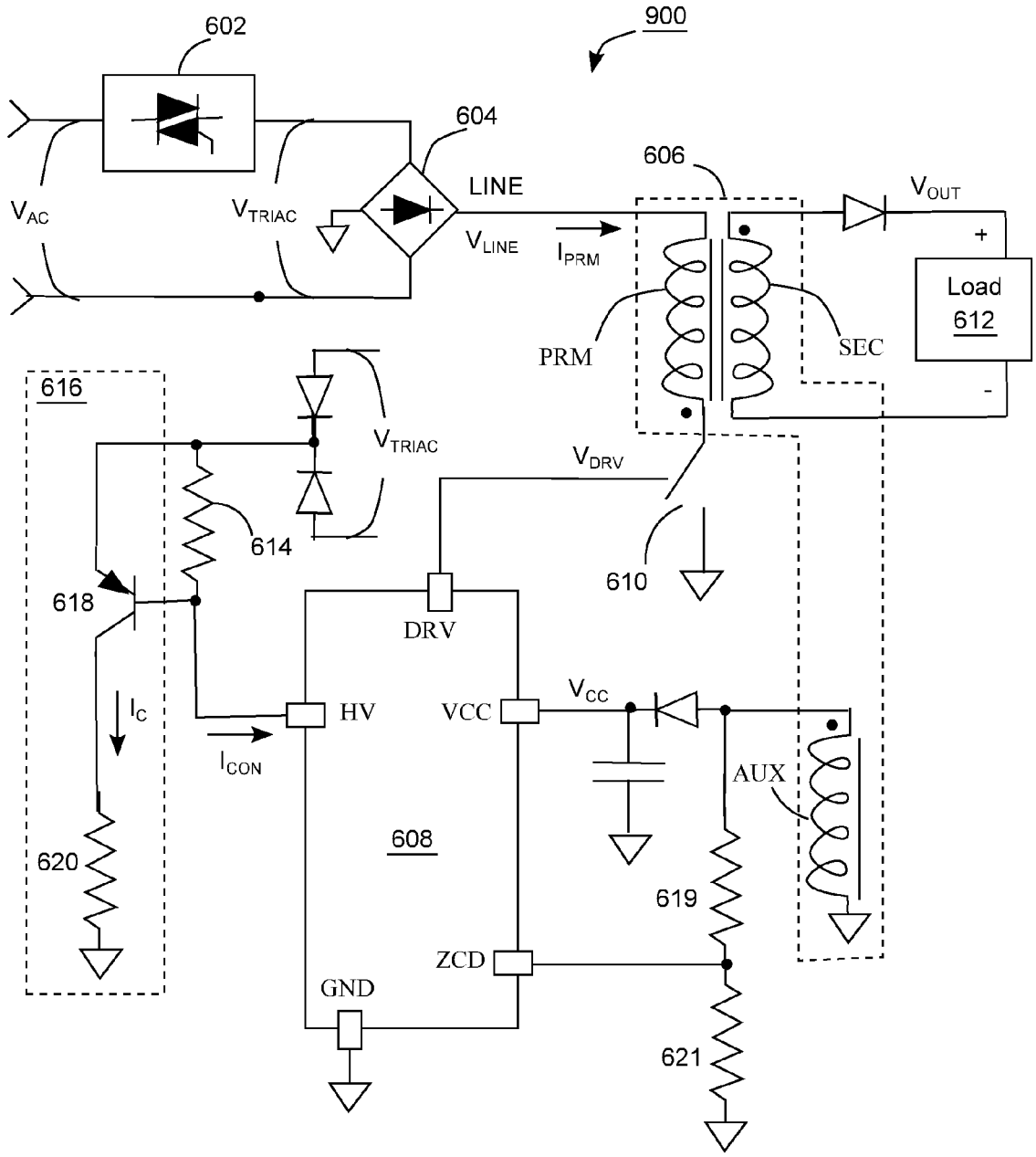
FIG. 3 demonstrates a power converter according to embodiments of the invention.

FIG. 3 demonstrates a power converter 900 according to embodiments of the invention. The power converter 900 has a flyback topology, but this invention is not limited to. For example, this invention might be suitable for converters with buck, booster, or buck-booster topologies.

Figure 1:
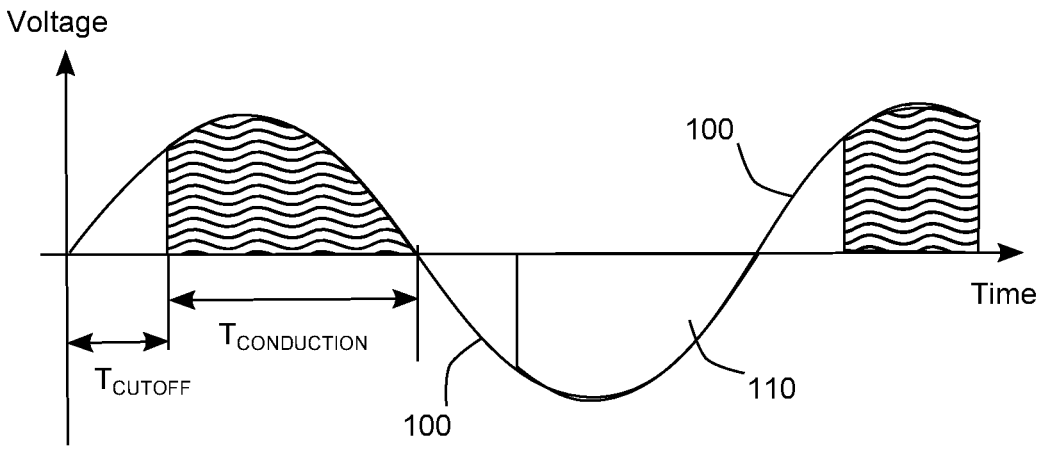
FIG. 1 (PRIOR ART)
FIGS. 1 and 2 demonstrate waveforms generated by a leading-edge TRIAC dimmer and a trailing-edge TRIAC dimmer, respectively.
Figure 2:
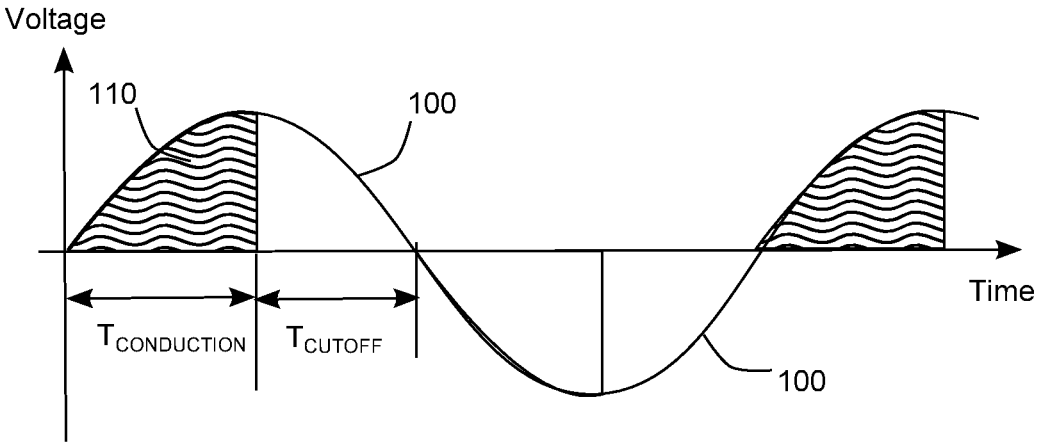
FIG. 2 (PRIOR ART)

Shown in FIG. 3, an AC voltage $V_{AC}$ might come from an outlet connected to mains supply, having 100 VAC, 110 VAC, or 220 VAC in magnitude, and oscillating at 50 Hz or 60 Hz. A TRIAC dimmer 602, which might be a leading-edge one or a trailing-edge one, stands for blocking a portion of the waveform of the AC voltage $V_{AC}$ to generate an AC input power source $V_{TRIAC}$. For instance, the AC voltage $V_{AC}$ has the waveform 100 shown in FIG. 1 or 2, and the AC input power source $V_{TRIAC}$ has the waveform outlining the shadowed portion 110. Abridge rectifier 604 provides full-wave rectification to the AC input power source $V_{TRIAC}$, and outputs a line voltage $V_{LINE}$ at a DC power line LINE and a ground voltage at a ground line.

Transformer 606 has a primary winding PRM, a secondary winding SEC and an auxiliary winding AUX. In one embodiment, power controller 608 is a pulse-width modulator in the form of a monolithic integrated circuit. During a normal operation, the power required for the operation of power controller 608 is provided by an operation power source $V_{CC}$. Power controller 608 drives pin DRV to provide PWM signal $V_{DRV}$, so as to turn ON or OFF power switch 610 alternatively and to control the primary-winding current $I_{PRM}$ passing through the primary winding PRM. When power switch 610 is turned ON, performing a short circuit, DC line voltage $V_{LINE}$ energizes the transformer 606. When power switch 610 is turned OFF, performing an open circuit, the transformer 606 de-energizes. During de-energizing, the secondary winding releases current to build output power source $V_{OUT}$ for powering a load 612, and the auxiliary winding AUX releases current to build the operation power source $V_{CC}$.

The power controller 608 has a zero-current detection pin ZCD, connected to which is a voltage divider including resistors 619 and 621. This voltage divider is connected in parallel with the auxiliary winding AUX. By clamping the voltage of zero-current detection pin ZCD at about the ground voltage when the power switch 610 is ON, the current out from zero-current detection pin ZCD to the auxiliary winding AUX is about in proportion to the line voltage $V_{LINE}$ of the DC power line LINE, which is about the same as the peak voltage $V_{TRIAC\text{-}PEAK}$ of the AC input power source $V_{TRIAC}$ in some embodiments. Accordingly, the power controller 608 is capable of sensing the peak voltage $V_{TRIAC\text{-}PEAK}$ via the help of zero-current detection pin ZCD. During de-energizing, the voltage at the zero-current detection pin ZCD is about in proportion to the voltage of the output power source $V_{OUT}$, and after the complete of de-energizing, the voltage at the zero-current detection pin ZCD starts oscillating. In one embodiment, the power controller 608 senses the voltage of the output power source $V_{OUT}$ and/or the complete of the de-energizing, via zero-current detection pin ZCD.

The power controller 608 has a high-voltage pin HV. Connected between the high-voltage pin HV and the AC input power source $V_{TRIAC}$ are two rectifying diodes and a current-limiting resistor 614. During a startup procedure when an operation voltage of the operation power source $V_{CC}$ is too low, power controller 608 drains a conduction current $I_{CON}$ from AC input power source $V_{TRIAC}$, via rectifying diodes, current-limiting resistor 614, high-voltage pin HV, in order to charge operation power source $V_{CC}$ and to increase the operation voltage. The current-limiting resistor 614 limits the magnitude of the conduction current $I_{CON}$. This charging could stop when the operation voltage exceeds a predetermined lower limit, and the startup procedure could stop as well. Later on, the operation voltage of the operation power source $V_{CC}$ could be sustained by the de-energizing of the transformer through the auxiliary winding AUX. During the startup procedure, PWM signal $V_{DRV}$ constantly turns OFF power switch 610.

Figure 4:
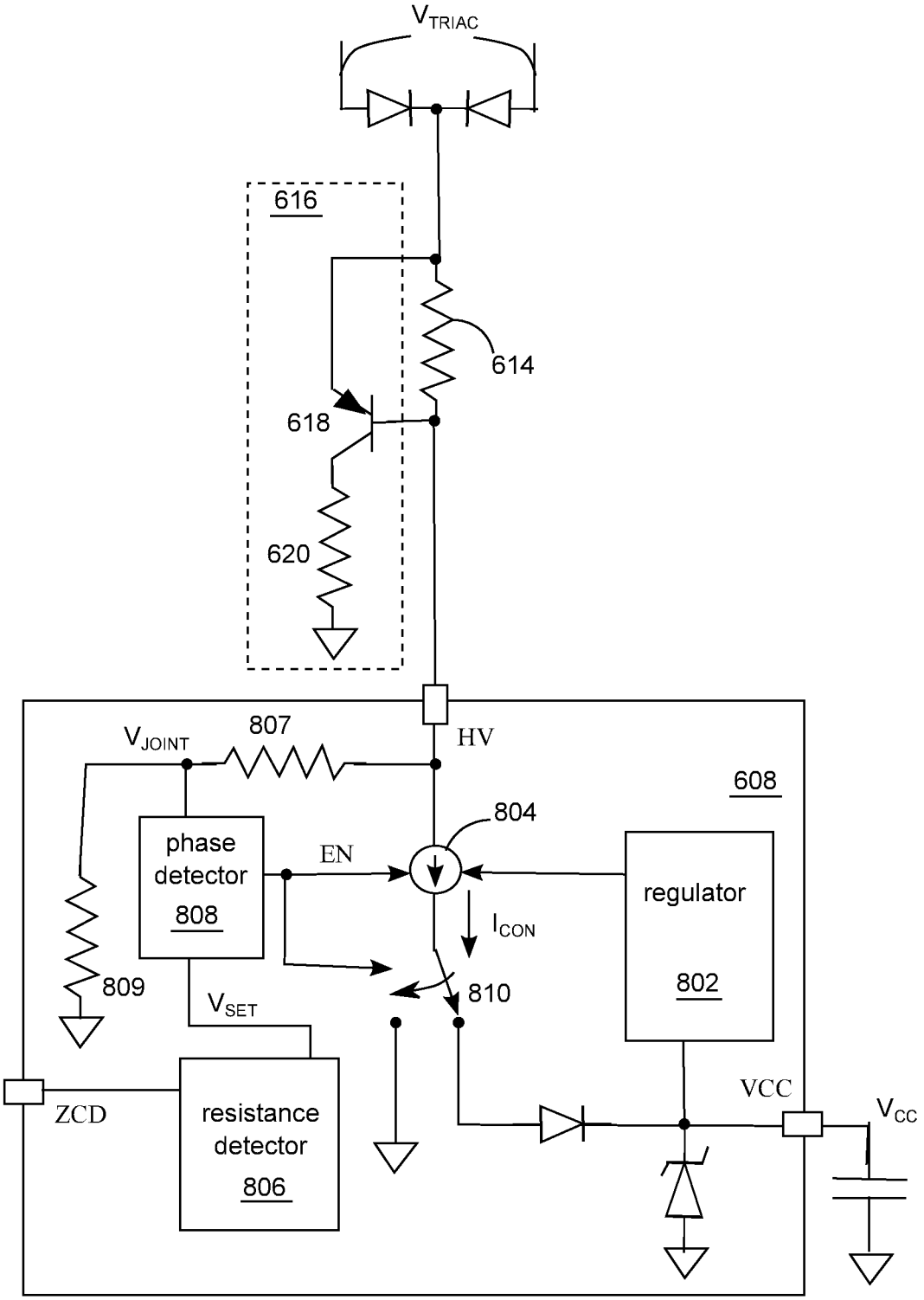
FIG. 4 demonstrates several circuit blocks relevant to the high-voltage pin HV.

FIG. 4 demonstrates several circuit blocks relevant to the high-voltage pin HV. During the startup procedure, resistance detector 806 could output a predetermined current out of zero-current detection pin ZCD, so that the joint voltage at the joint between resistors 619 and 621 (of FIG. 3) is substantially in proportion to the effective resistance of the resistors 619 and 621 in parallel. Based on the joint voltage, the resistance detector 806 could make a corresponding record, in a register for example, according to which a setting voltage $V_{SET}$ is provided during a normal operation. The power controller 608 could detect the amplitude of AC input power source $V_{TRIAC}$ via high-voltage pin HV during the normal operation. If that amplitude is determined to be too low, or below the setting voltage $V_{SET}$ for example, then the power controller 608 deems it as an indication that TRIAC dimmer 602 is currently blocking the waveform of the AC voltage $V_{AC}$ and the present moment is within a cutoff time $T_{CUTOFF}$. Therefore, the power controller 608 drains from the input power source $V_{TRIAC}$, through the rectifying diodes, resistor 614 and pin high-voltage pin HV, a conduction current $I_{CON}$, which, instead of charging the operation power source $V_{CC}$, goes and releases to the ground line. This conduction $I_{CON}$ acts as the holding current that the TRIAC dimmer 602 needs for holding the cutoff time $T_{CUTOFF}$.

The effective resistance of resistors 619 and 621 in parallel determines the setting voltage $V_{SET}$, equivalently determining the criterion that the power controller 60 uses to differentiate a cutoff time $T_{CUTOFF}$ from a conduction time $T_{CONDUCTION}$.

FIG. 3 optionally includes a discharge circuit 616, in order to provide a higher holding current. The discharge circuit 616 has a PNP BJT 618 and a resistor 620. The base and the emitter of the BJT 618 are coupled to the high-voltage pin HV and the AC input power source $V_{TRIAC}$, while the resistor 614 is connected between the base and the emitter. The collector is connected to the ground line through resistor 620. When the conduction current $I_{CON}$ occurs, it substantially passes through the base of BJT 618. Due to the amplification provided by the BJT 618, collector current $I_C$, larger than the conduction current $I_{CON}$, occurs when the conduction current $I_{CON}$ happens, and similar with the conduction current $I_{CON}$, it also drains from the AC input power source $V_{TRIAC}$ to the ground line. So the combination of the collector current $I_C$ and the conduction current $I_{CON}$ could perform as a larger holding current for a TRIAC dimmer. When the conduction current $I_{CON}$ is about 0, the BJT 618 is switched to be OFF, the collector current $I_C$ is also about 0, so the discharge circuit 616 performs as a high-impedance circuit to isolate the AC input power source $V_{TRIAC}$ from the ground line.

Please refer to FIG. 4. A regulator 802 acts as a high-voltage startup control circuit, to detect the operation power source $V_{CC}$ and control the high-voltage device 804 for providing the conduction current $I_{CON}$. The high-voltage device 804 could be deemed as a controllable current source and is capable of sustaining a high voltage, more than 240V for example, occurring at the high-voltage pin HV. For instance, the regulator 802 is configured to turn ON the high-voltage device 804 for providing a conduction current $I_{CON}$ of 4 mA when the operation voltage of the operation power source $V_{CC}$ is below 10V. The regulator 802 could be configured to turn OFF the high-voltage device 804 when the operation voltage exceeds 16V, and the conduction current $I_{CON}$ is about 0 mA as a result.

Via the zero-current detection pin ZCD, a resistance detector 806 detects the joint voltage at the joint between the resistors 619 and 621 during a startup procedure, to generate a setting voltage $V_{SET}$. During a normal operation, the detected voltage $V_{JOINT}$ at the joint between resistors 807 and 809 in FIG. 4 could be in proportion to the amplitude of the AC input power source $V_{TRIAC}$. A phase detector 808 compares the setting voltage $V_{SET}$ with the detected voltage $V_{JOINT}$ to determine whether the present moment is within a cutoff time $T_{CUTOFF}$. For example, if the detected voltage $V_{JOINT}$ exceeds the setting voltage $V_{SET}$, the present moment is determined to belong to a conduction time $T_{CONDUCTION}$, so the phase detector 808 asserts enable signal EN to control de-multiplexer 810, which accordingly forwards the conduction current $I_{CON}$, if any, to charge the operation power source $V_{CC}$. If, in the opposite, the setting voltage $V_{SET}$ exceeds the detected voltage $V_{JOINT}$, the present moment is determined to belong to a cutoff time $T_{CUTOFF}$, and the phase detector 808 makes the high-voltage device 804 drain the conduction current $I_{CON}$ and the de-multiplexer 810 forward the conduction current $I_{CON}$ directly to the ground line. Therefore, resistors 807 and 809, and the phase detector 808 perform together as a cutoff-time detection circuit for detecting the occurrence of a cutoff time $T_{CUTOFF}$.

In some embodiments, the high-voltage device 804 performs two major functions: 1) providing the current to charge the operation power source $V_{CC}$ during a startup procedure; and 2) providing the holding current required by a TRIAC dimmer 602 during a cutoff time $T_{CUTOFF}$.

In some embodiments, only if the phase detector 808 determines the present moment is within a cutoff time $T_{CUTOFF}$, or the operation voltage of the operation power source $V_{CC}$ is below 16V, then the high-voltage device 804 is turned ON to provide a conduction current $I_{CON}$ of 4 mA. Otherwise, the high-voltage device 804 is turned OFF and the conduction current $I_{CON}$ is kept as 0 mA.

Figure 5:
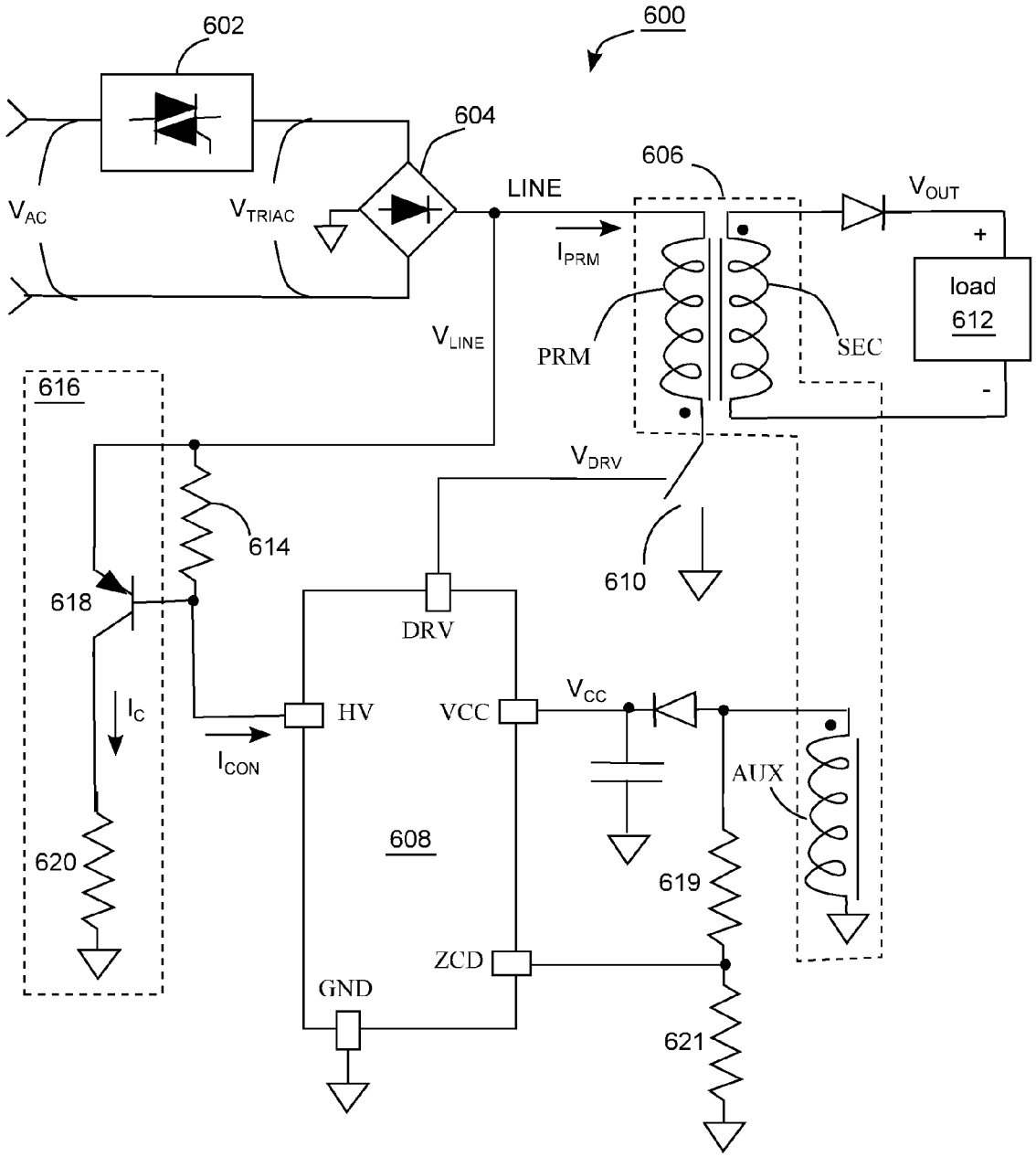
FIG. 5 shows another power converter according to embodiments of the invention.

FIG. 5 shows another power converter 600 according to embodiments of the invention. Unlike the power converter 900 in FIG. 3, resistor 614 and discharge circuit 616 in FIG. 5 are connected to the DC power line LINE for receiving the line voltage $V_{LINE}$. The line voltage $V_{LINE}$ in FIG. 5 preferably follows with the absolute value of the voltage of the AC input power source $V_{TRIAC}$ all the time. In other words, the line voltage $V_{LINE}$ in FIG. 5 should present the absolute value of the voltage of the AC input power source $V_{TRIAC}$. Detail of the power converter 600 in FIG. 5 is omitted hereinafter because it is self-explanatory in view of the aforementioned teaching regarding to the power converter 900 in FIG. 3.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A power converter suitable for converting an input power source into an output power source, the power converter comprising:

a power controller powered by an operation power source with an operation voltage, comprising:

a high-voltage pin coupled to the input power source;

a high-voltage device capable of draining a conduction current from the input power source via the high-voltage pin;

a high-voltage startup control circuit, for detecting the operation voltage;

a cutoff-time detection circuit for detecting an input voltage of the input power source to provide a detected voltage; and a demultiplexer coupled to the high-voltage device, the high-voltage startup control circuit and the cutoff-time detection circuit, for forwarding the conduction current to the operation power source during a startup procedure and to a ground line when the detected voltage is below a setting voltage;

wherein the conduction current charges the operation power source during the startup procedure; and the conduction current goes through the high-voltage device and does not charge the operation power source when the detected voltage is below the setting voltage.

2. The power converter of claim 1, wherein the cutoff-time detection circuit comprises two resistors connected in series between the high-voltage pin and the ground line.

3. The power converter of claim 1, further comprising:

a transformer with a primary winding, a secondary winding, and an auxiliary winding; and two resistors connected in series via a joint, and between two ends of the auxiliary winding;

wherein the power controller comprises a resistance detector coupled to the joint for providing the setting voltage.

4. The power converter of claim 3, wherein the power controller is a pulse-width modulator providing a PWM signal to a power switch controlling a primary-winding current through the primary winding.

5. The power converter of claim 3, wherein the input power source is an alternating-current input power source, the power converter further comprising:

a bridge rectifier, for rectifying the input power source to provide a direct-current voltage power line coupled to the primary winding.

6. The power converter of claim 1, further comprising:

a current-limiting resistor, connected between the high-voltage pin and the input power source.

7. The power converter of claim 6, further comprising:

a bipolar junction transistor with a base, an emitter, and a collector;

wherein the base and the emitter are coupled to two ends of the current-limiting resistor respectively, and the collector is coupled to the ground line.

8. The power converter of claim 1, further comprising:

a TRIAC dimmer coupled to receive an alternating-current power source and to output the input power source.

* * * * *